US009722304B2

(12) United States Patent
Yang et al.

(10) Patent No.: US 9,722,304 B2
(45) Date of Patent: Aug. 1, 2017

(54) MOBILE DEVICE

(71) Applicant: Acer Incorporated, New Taipei (TW)

(72) Inventors: Chung-Wen Yang, New Taipei (TW); Chuan-Chun Wang, New Taipei (TW); Ching-Chi Lin, New Taipei (TW); Kun-Sheng Chang, New Taipei (TW); Kuan-Jen Chung, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 122 days.

(21) Appl. No.: 14/679,159

(22) Filed: Apr. 6, 2015

(65) Prior Publication Data

US 2016/0190699 A1 Jun. 30, 2016

(30) Foreign Application Priority Data

Dec. 26, 2014 (TW) ..... 103145711 A

(51) Int. Cl.

| | |
|---|---|
| ***H01Q 1/24*** | (2006.01) |
| ***H01Q 9/42*** | (2006.01) |
| ***H01Q 1/38*** | (2006.01) |
| ***H01Q 5/371*** | (2015.01) |

(52) U.S. Cl.

CPC ..... *H01Q 1/38* (2013.01); *H01Q 1/243* (2013.01); *H01Q 5/371* (2015.01); *H01Q 9/42* (2013.01)

(58) Field of Classification Search

CPC .. H01Q 9/30; H01Q 9/42; H01Q 1/22; H01Q 1/2258; H01Q 1/2266; H01Q 1/24; H01Q 1/243; H01Q 1/245; H01Q 1/38; H01Q 5/30; H01Q 5/307; H01Q 5/342; H01Q 5/354; H01Q 5/364; H01Q 5/371

USPC ..... 343/700 MS, 702

See application file for complete search history.

(56) References Cited

U.S. PATENT DOCUMENTS

| | | | | |
|---|---|---|---|---|
| 7,576,698 | B2 * | 8/2009 | Cheng | H01Q 1/2291 343/700 MS |
| 7,646,349 | B2 * | 1/2010 | Wee | H01Q 1/245 343/700 MS |
| 2007/0030202 | A1 | 2/2007 | Lee et al. | |

(Continued)

FOREIGN PATENT DOCUMENTS

| | | |
|---|---|---|
| TW | 563274 | 11/2003 |
| TW | M420861 | 1/2012 |

OTHER PUBLICATIONS

Chinese language office action dated Feb. 24, 2016, issued in application No. TW 103145711.

*Primary Examiner* — Tho G Phan
*Assistant Examiner* — Patrick Holecek
(74) *Attorney, Agent, or Firm* — McClure, Qualey & Rodack, LLP

(57) ABSTRACT

A mobile device includes a ground element and an antenna structure. The antenna structure includes a ground branch, a feeding branch, a low-frequency radiation branch, and a high-frequency radiation branch. The feeding branch is coupled through the ground branch to the ground element. The low-frequency radiation branch is coupled to the feeding branch. The high-frequency radiation branch is coupled to the feeding branch. The low-frequency radiation branch has a meandering structure for reducing the SAR (Specific Absorption Rate) of the antenna structure.

9 Claims, 4 Drawing Sheets

(56) References Cited

U.S. PATENT DOCUMENTS

| | | | | |
|---|---|---|---|---|
| 2008/0055160 | A1 | 3/2008 | Kim et al. | |
| 2009/0124215 | A1 * | 5/2009 | Nysen | H01Q 1/2275 455/90.1 |

* cited by examiner

MOBILE DEVICE

CROSS REFERENCE TO RELATED APPLICATIONS

This Application claims priority of Taiwan Patent Application No. 103145711 filed on Dec. 26, 2014, the entirety of which is incorporated by reference herein.

BACKGROUND OF THE INVENTION

Field of the Invention

The disclosure generally relates to a mobile device, and more specifically, to a mobile device including an antenna structure.

Description of the Related Art

With advancement in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna is indispensable in a mobile device supporting wireless communication. To prevent electromagnetic waves transmitted by an antenna from negatively affecting the human body, the SAR (Specific Absorption Rate) of a mobile device is prescribed and limited by law. It becomes a critical challenge for current designers to design an antenna element which has good communication quality and meets the requirements of the law.

BRIEF SUMMARY OF THE INVENTION

In a preferred embodiment, the invention is directed to a mobile device. The mobile device includes a ground element and an antenna structure. The antenna structure includes a ground branch, a feeding branch, a low-frequency radiation branch, and a high-frequency radiation branch. The feeding branch has a feeding point. The feeding branch is coupled through the ground branch to the ground element. The low-frequency radiation branch is coupled to the feeding branch. The high-frequency radiation branch is coupled to the feeding branch. The low-frequency radiation branch has a meandering structure.

In some embodiments, the meandering structure is configured to reduce an SAR (Specific Absorption Rate) of the antenna structure.

In some embodiments, a current maximum point of the low-frequency radiation branch is positioned at the meandering structure.

In some embodiments, the antenna structure is disposed adjacent to an edge of the mobile device, and the meandering structure extends away from the edge of the mobile device.

In some embodiments, the meandering structure extends toward the ground branch.

In some embodiments, the meandering structure substantially has a U-shape or a W-shape.

In some embodiments, a first end of the feeding branch is coupled through the ground branch to the ground element, a first end of the low-frequency radiation branch is coupled to a second end of the feeding branch, a second end of the low-frequency radiation branch is open, a first end of the high-frequency radiation branch is coupled to the second end of the feeding branch, and a second end of the high-frequency radiation branch is open.

In some embodiments, the second end of the low-frequency radiation branch and the second end of the high-frequency radiation branch extend in opposite directions.

In some embodiments, the mobile device further includes a display device. The antenna structure is disposed between the display device and an edge of the mobile device.

In some embodiments, the feeding branch and the low-frequency radiation branch are excited to generate a low-frequency band, the feeding branch and the high-frequency radiation branch are excited to generate a high-frequency band, the low-frequency band is substantially from 2400 MHz to 2484 MHz, and the high-frequency band is substantially from 5150 MHz to 5850 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Figure 1:
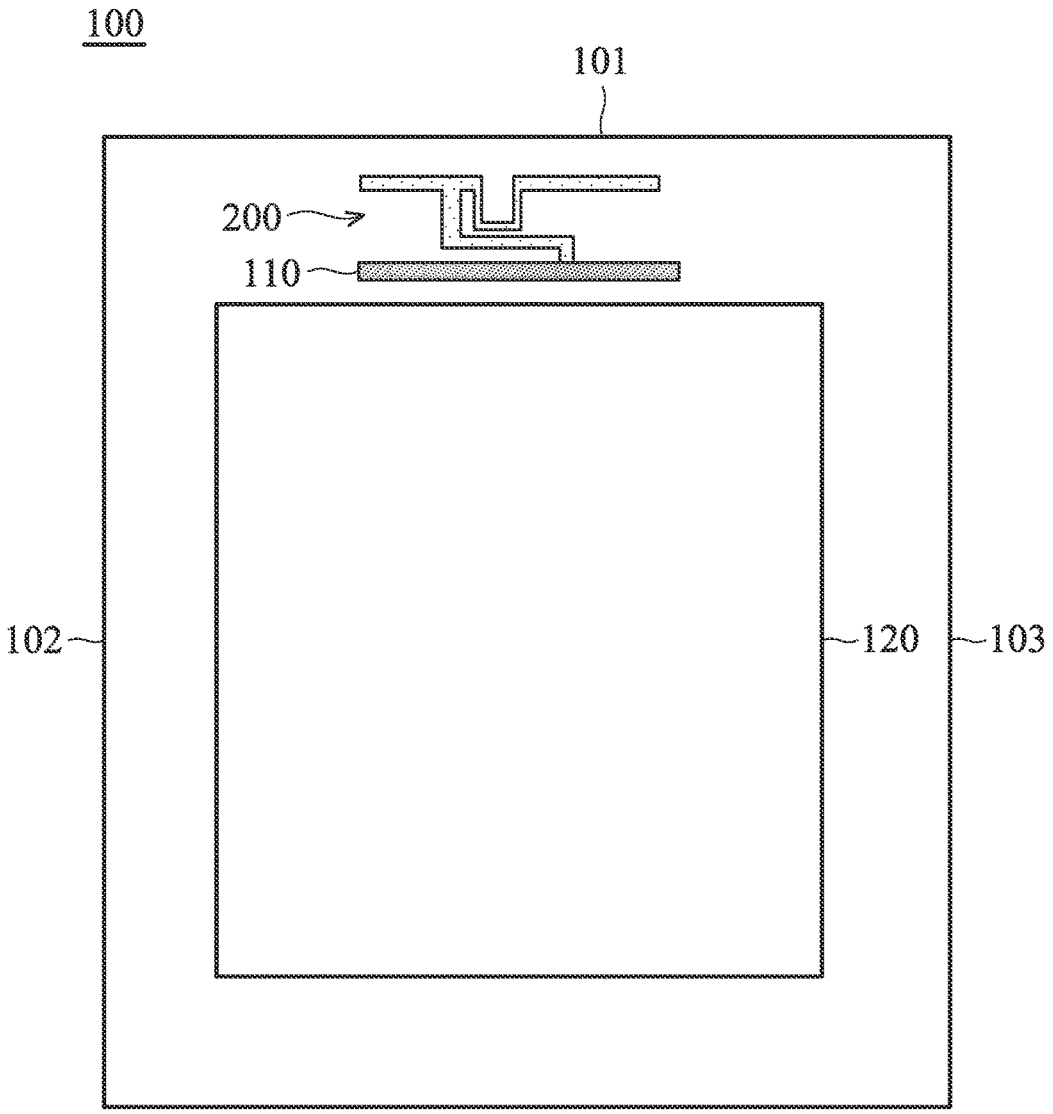
FIG. 1 is a diagram of a mobile device according to an embodiment of the invention.

FIG. 1 is a diagram of a mobile device 100 according to an embodiment of the invention. The mobile device 100 may be a smartphone, a tablet computer, or a notebook computer. As shown in FIG. 1, the mobile device 100 includes a ground element 110, an antenna structure 200, and a display device 120. The ground element 110 may be a metal plane disposed on a PCB (Printed Circuit Board). The antenna structure 200 may be made of metal, such as copper, silver, aluminum, iron, or their alloys. The antenna structure 200 may be disposed between the display device 120 and an edge 101 of the mobile device 100. The display device 120 may be any type of electronic display device, such as an LCD (Liquid Crystal Display) or an OLED (Organic Electroluminescent Display). In the embodiment of FIG. 1, the antenna structure 200 is disposed on the top of the mobile device 100, but the invention is not limited thereto. In alternative embodiments, adjustments are made such that the antenna structure 200 is disposed at a side of the mobile device. For example, the antenna structure 200 may be disposed between the display device 120 and another edge 102 (or 103) of the mobile device 100. It should be understood that the mobile device 100 may further include other components, such as a processor, a speaker, a battery, a touch control module, a sound control module, and/or a housing (not shown).

Figure 2:
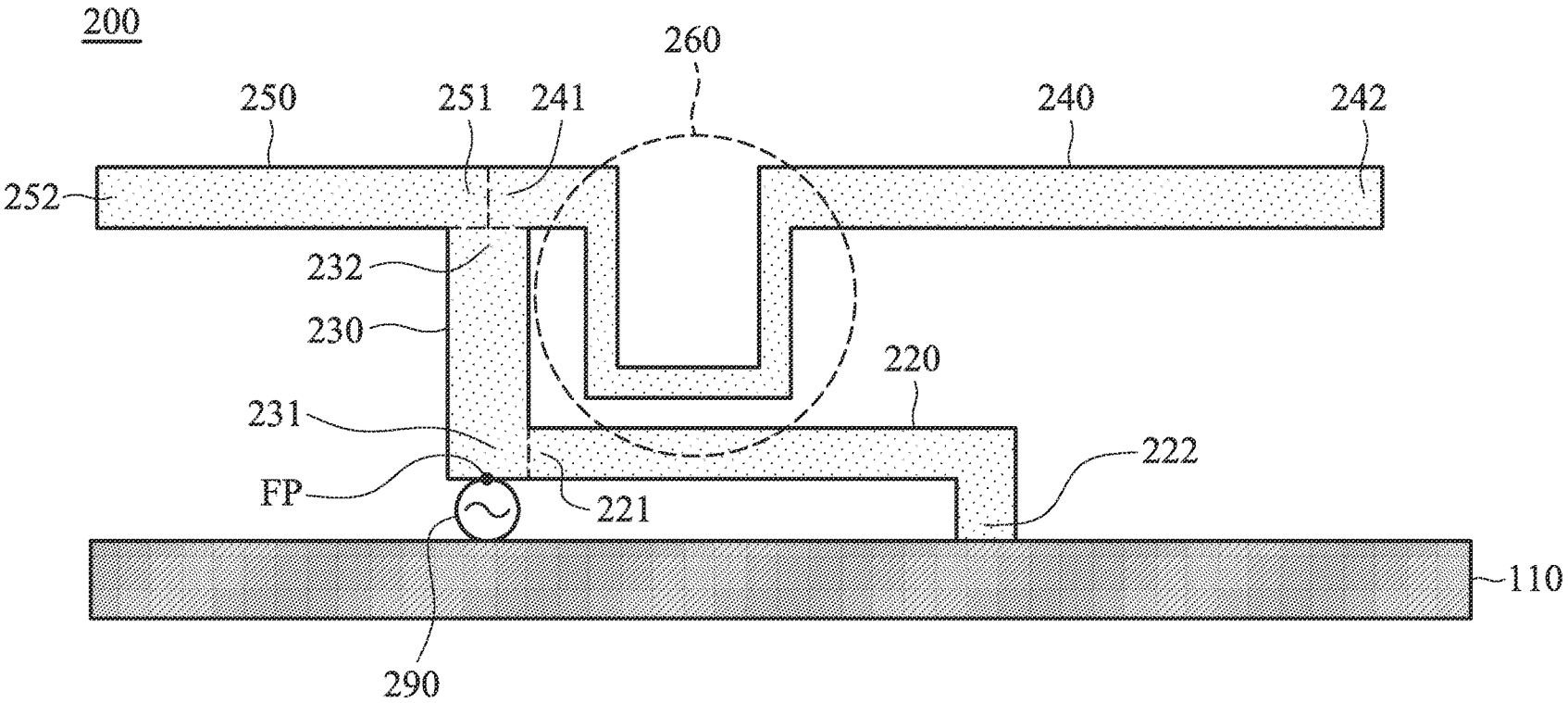
FIG. 2 is a diagram of an antenna structure according to an embodiment of the invention.

FIG. 2 is a diagram of the antenna structure 200 according to an embodiment of the invention. FIG. 2 is used to illustrate the detailed features of the antenna structure 200 of FIG. 1. As shown in FIG. 2, the antenna structure 200 includes a ground branch 220, a feeding branch 230, a low-frequency radiation branch 240, and a high-frequency radiation branch 250. The above branches are all made of metal, such as copper, silver, aluminum, iron, or their alloys. The feeding branch 230 has a feeding point FP. The feeding branch 230 is coupled through the ground branch 220 to the ground element 110. The low-frequency radiation branch 240 and the high-frequency radiation branch 250 are both coupled to the feeding branch 230. The length of the low-frequency radiation branch 240 is longer than that of the high-frequency radiation branch 250.

The ground branch 220 may substantially have an L-shape. The feeding branch 230 may substantially have a straight-line shape. The low-frequency radiation branch 240 may have a meandering structure 260. The high-frequency radiation branch 250 may substantially have a straight-line shape. The feeding point FP is positioned at a first end 231 of the feeding branch 230. The feeding point FP may be coupled through a coaxial cable (not shown) to a signal source 290. The signal source 290 may be an RF (Radio Frequency) module for exciting the antenna structure 200. The first end 231 of the feeding branch 230 is coupled to a first end 221 of the ground branch 220. A second end 222 of the ground branch 220 is coupled to the ground element 110. A first end 241 of the low-frequency radiation branch 240 is coupled to a second end 232 of the feeding branch 230. A second end 242 of the low-frequency radiation branch 240 is open. A first end 251 of the high-frequency radiation branch 250 is coupled to the second end 232 of the feeding branch 230. A second end 252 of the high-frequency radiation branch 250 is open. The second end 242 of the low-frequency radiation branch 240 and the second end 252 of the high-frequency radiation branch 250 extend in opposite directions.

The antenna structure 200 is disposed adjacent to the edge 101 of the mobile device 100. In the antenna structure 200, the meandering structure 260 of the low-frequency radiation branch 240 extends away from the edge 101 of the mobile device 100. In other words, the meandering structure 260 extends toward the ground branch 220. The meandering structure 260 substantially has a U-shape. In alternative embodiments, the meandering structure 260 has a different shape, such as an N-shape, an S-shape, or a Z-shape.

Please refer to FIG. 1 and FIG. 2. The operation theory of the antenna structure 200 may be described as follows. The feeding branch 230 and the low-frequency radiation branch 240 are excited to generate a low-frequency band. The feeding branch 230 and the high-frequency radiation branch 250 are excited to generate a high-frequency band. A total length of the feeding branch 230 and the low-frequency radiation branch 240 is substantially equal to 0.25 wavelength of the low-frequency band. A total length of the feeding branch 230 and the high-frequency radiation branch 250 is substantially equal to 0.25 wavelength of the high-frequency band. For example, the low-frequency band may be substantially from 2400 MHz to 2484 MHz, and the high-frequency band may be substantially from 5150 MHz to 5850 MHz. Accordingly, the mobile device 100 and the antenna structure 200 can support at least the communication frequency bands of Wi-Fi and Bluetooth.

Note that, because of the frequency multiplication effect, the feeding branch 230 and the low-frequency radiation branch 240 are further excited to generate another higher-order resonant mode in the above high-frequency band (e.g., a 5 GHz frequency band). This higher-order resonant mode causes the SAR of a conventional PIFA (Planer Inverted F Antenna) not to meet the requirements of law in the high-frequency band. The invention newly adds the meandering structure 260 on the low-frequency radiation branch 240 so as to overcome the problem of the prior art. In a preferred embodiment, the current maximum point of the low-frequency radiation branch 240 is exactly positioned at the meandering structure 260. The frequency multiplication of the current is at around 5 GHz. More specifically, a resonant path from the feeding point FP to the meandering structure 260 of the low-frequency radiation branch 240 has a length which is substantially equal to 0.125 wavelength of the aforementioned low-frequency band, or 0.25 wavelength of the aforementioned high-frequency band. The meander structure 260 causes the currents thereon to flow in opposite directions, and reduces the total current magnitude and the total radiation field strength, thereby eliminating the negative effect on the SAR by the aforementioned higher-order resonant mode. Furthermore, the meandering structure 260 extends toward the interior of the mobile device 100, and therefore the current hotspot of the antenna structure 200 is away from the edge 101 of the mobile device 100. That is, the current maximum point on the low-frequency radiation branch 240 is directed away from a human body of a user. As a result, the meandering structure 260 effectively reduces the SAR of the antenna structure 200 in a high-frequency band, and the mobile device 100 and the antenna structure 200 can easily meet legal requirements.

Figure 3:
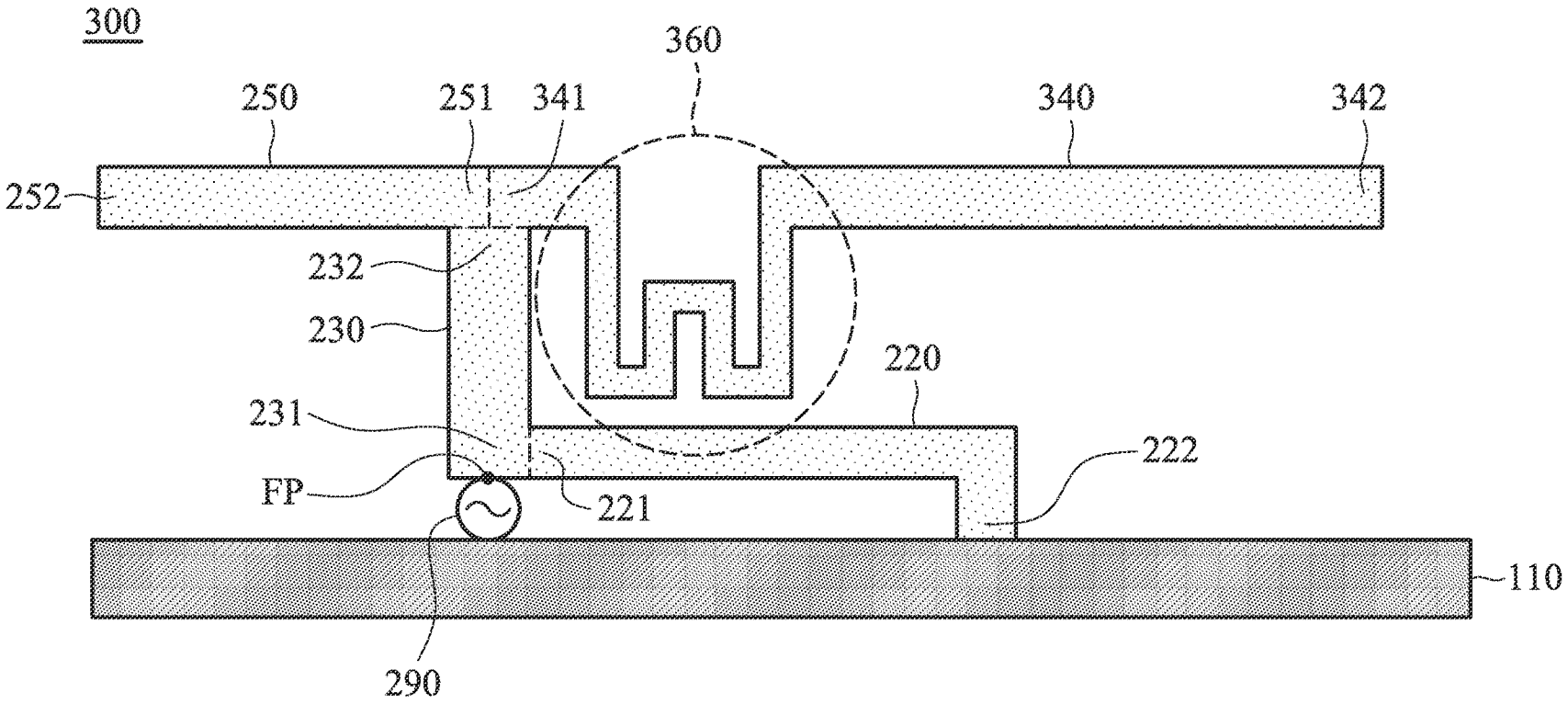
FIG. 3 is a diagram of an antenna structure according to another embodiment of the invention.

FIG. 3 is a diagram of the antenna structure 300 according to another embodiment of the invention. FIG. 3 is similar to FIG. 2. The difference between the two embodiments is that a low-frequency radiation branch 340 of the antenna structure 300 includes a meandering structure 360, which substantially has a W-shape. Every two adjacent parallel branches of the meandering structure 360 have a spacing therebetween which is about 0.5 mm. In order to reduce the space of design, the width of the meandering structure 360 is thinner than that of the other portion of the low-frequency radiation branch 340. Other features of the antenna structure 300 of FIG. 3 are similar to those of the antenna structure 200 of FIG. 2. Accordingly, the two embodiments can achieve similar levels of performance.

Figure 4:
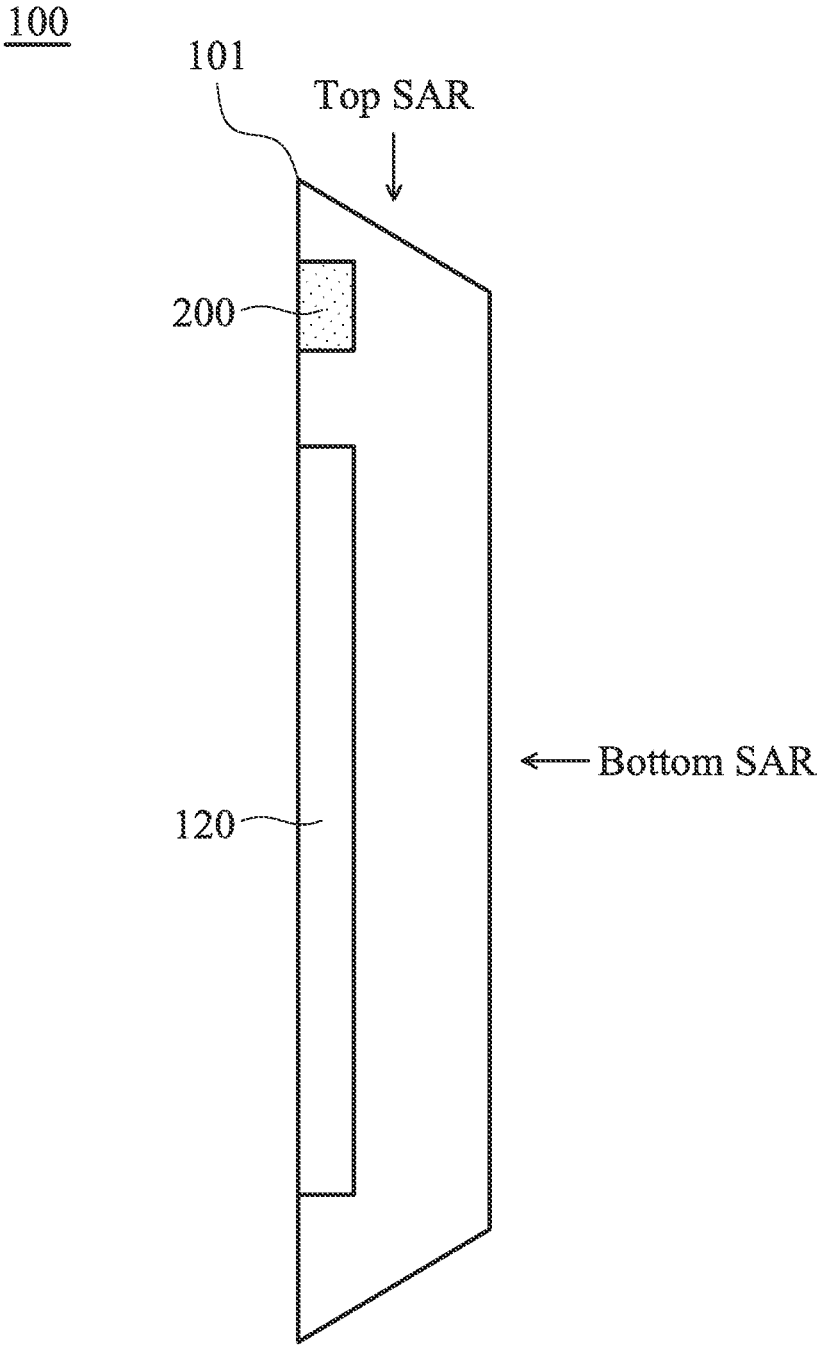
FIG. 4 is a diagram of measurement of SAR (Specific Absorption Rate) of an antenna structure according to an embodiment of the invention.

FIG. 4 is a diagram of the measurement of the SAR of the antenna structure 300 according to an embodiment of the invention. FIG. 4 is used to illustrate how the SAR is measured on the top and bottom of the mobile device 100 (i.e., the top SAR and the bottom SAR shown in FIG. 4). Please refer to FIG. 4 and the following Table I.

TABLE I

| Measured SAR (Antenna Gain = −2.95 dBi) | | |
|---|---|---|
| | SAR measured on the top | SAR measured on the bottom |
| Conventional PIFA | 2.38 | 2.52 |
| Proposed Antenna Structure | 1.51 | 2.79 |

Table I shows a comparison of the measured SAR. According to the measurement, the invention has significantly lower SAR than a conventional PIFA does when these antenna structures have the same antenna gain (e.g., the antenna gain may be set to both −2.95 dBi). More specifically, the proposed antenna structure has SAR measured on the top, and it is almost 0.6 times that of the conventional design. As a result, the antenna structure of the invention can easily meet the SAR criteria prescribed by law.

Note that the above element sizes, element shapes, and frequency ranges are not limitations of the invention. An antenna designer can fine-tune these settings or values according to different requirements. It should be understood that the mobile device and the antenna structure of the invention are not limited to the configurations of FIGS. 1-4. The invention may merely include any one or more features of any one or more embodiments of FIGS. 1-4. In other words, not all of the features displayed in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a ground element; and an antenna structure, comprising:

a ground branch;

a feeding branch, having a feeding point, wherein the feeding branch is coupled through the ground branch to the ground element;

a low-frequency radiation branch, coupled to the feeding branch; and a high-frequency radiation branch, coupled to the feeding branch;

wherein the low-frequency radiation branch has a meandering structure;

wherein the feeding branch and the low-frequency radiation branch are excited to generate a low-frequency band, the feeding branch and the high-frequency radiation branch are excited to generate a high-frequency band, the low-frequency band is substantially from 2400 MHz to 2484 MHz, and the high-frequency band is substantially from 5150 MHz to 5850 MHz;

wherein a resonant path from the feeding point to the meandering structure of the low-frequency radiation branch has a length which is substantially equal to 0.125 wavelength of the low-frequency band, or 0.25 wavelength of the high-frequency band.

2. The mobile device as claimed in claim 1, wherein the meandering structure is configured to reduce an SAR (Specific Absorption Rate) of the antenna structure.

3. The mobile device as claimed in claim 1, wherein a current maximum point of the low-frequency radiation branch is positioned at the meandering structure.

4. The mobile device as claimed in claim 1, wherein the antenna structure is disposed adjacent to an edge of the mobile device, and the meandering structure extends away from the edge of the mobile device.

5. The mobile device as claimed in claim 1, wherein the meandering structure extends toward the ground branch.

6. The mobile device as claimed in claim 1, wherein the meandering structure substantially has a U-shape or a W-shape.

7. The mobile device as claimed in claim 1, wherein a first end of the feeding branch is coupled through the ground branch to the ground element, a first end of the low-frequency radiation branch is coupled to a second end of the feeding branch, a second end of the low-frequency radiation branch is open, a first end of the high-frequency radiation branch is coupled to the second end of the feeding branch, and a second end of the high-frequency radiation branch is open.

8. The mobile device as claimed in claim 7, wherein the second end of the low-frequency radiation branch and the second end of the high-frequency radiation branch extend in opposite directions.

9. The mobile device as claimed in claim 1, further comprising:

a display device, wherein the antenna structure is disposed between the display device and an edge of the mobile device.

* * * * *